US008938850B1

(12) United States Patent
Velez

(10) Patent No.: US 8,938,850 B1
(45) Date of Patent: Jan. 27, 2015

(54) STAIR VACUUM DEVICE

(71) Applicant: Arelis C. Velez, Pembroke Pines, FL (US)

(72) Inventor: Arelis C. Velez, Pembroke Pines, FL (US)

( * ) Notice: Subject to any disclaimer, the term of this patent is extended or adjusted under 35 U.S.C. 154(b) by 30 days.

(21) Appl. No.: 13/922,835

(22) Filed: Jun. 20, 2013

(51) Int. Cl.
*A47L 5/36* (2006.01)

(52) U.S. Cl.
CPC ..... *A47L 5/367* (2013.01); *A47L 2201/00* (2013.01)
USPC ..... 15/319; 15/339; 15/340.1; 15/340.4; 15/384; 15/385

(58) Field of Classification Search
CPC ..... A47L 5/36; A47L 5/367; A47L 2201/00
USPC ..... 15/319, 339, 340.1, 340.4, 384, 385
IPC ..... A47L 5/36, 9/00
See application file for complete search history.

(56) References Cited

U.S. PATENT DOCUMENTS

| | | | | |
|---|---|---|---|---|
| 3,820,808 | A | 6/1974 | Brunning et al. | |
| D266,707 | S | 10/1982 | Bunyea | |
| 4,993,912 | A | 2/1991 | King et al. | |
| 5,515,934 | A | 5/1996 | Davis | |
| 5,937,477 | A | 8/1999 | Dyson | |
| D524,495 | S | 7/2006 | Ljunggren | |
| 7,281,295 | B2 | 10/2007 | Mattingly et al. | |
| 8,061,460 | B2 | 11/2011 | Scheck | |
| 2005/0055792 | A1 * | 3/2005 | Kisela et al. | 15/319 |
| 2007/0163075 | A1 | 7/2007 | Butler et al. | |

FOREIGN PATENT DOCUMENTS

| | | | |
|---|---|---|---|
| JP | 2005216021 | * | 8/2005 |
| WO | WO2012/086604 | * | 6/2012 |

* cited by examiner

*Primary Examiner* — David Redding

(57) ABSTRACT

A stair vacuum device for automatically vacuuming stairs includes a pair of vacuum units coupled together by a connector. Each vacuum unit comprises a vacuum housing having a slot extending through a bottom surface of the vacuum housing. A plurality of side rollers is coupled to the vacuum housing for moving the vacuum housing in a first direction. A plurality of forward rollers is coupled to the vacuum housing for moving the vacuum housing in a second direction transverse to the first direction. A suction device is coupled to and positioned in the vacuum housing such that the suction device provides suction through the slot in the vacuum housing. The connector couples the vacuum units together in spaced relationship wherein the vacuum units move in tandem to vacuum the adjacent stair surfaces simultaneously.

14 Claims, 4 Drawing Sheets

STAIR VACUUM DEVICE

BACKGROUND OF THE DISCLOSURE

Field of the Disclosure

The disclosure relates to vacuum devices and more particularly pertains to a new vacuum device for automatically vacuuming stairs.

SUMMARY OF THE DISCLOSURE

An embodiment of the disclosure meets the needs presented above by generally comprising a pair of vacuum units coupled together by a connector. Each vacuum unit comprises a vacuum housing having a slot extending through a bottom surface of the vacuum housing. A plurality of side rollers is coupled to the vacuum housing for moving the vacuum housing in a first direction. A plurality of forward rollers is coupled to the vacuum housing for moving the vacuum housing in a second direction transverse to the first direction. A suction device is coupled to and positioned in the vacuum housing such that the suction device provides suction through the slot in the vacuum housing. The connector couples the vacuum units together in spaced relationship wherein the vacuum units move in tandem to vacuum the adjacent stair surfaces simultaneously.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
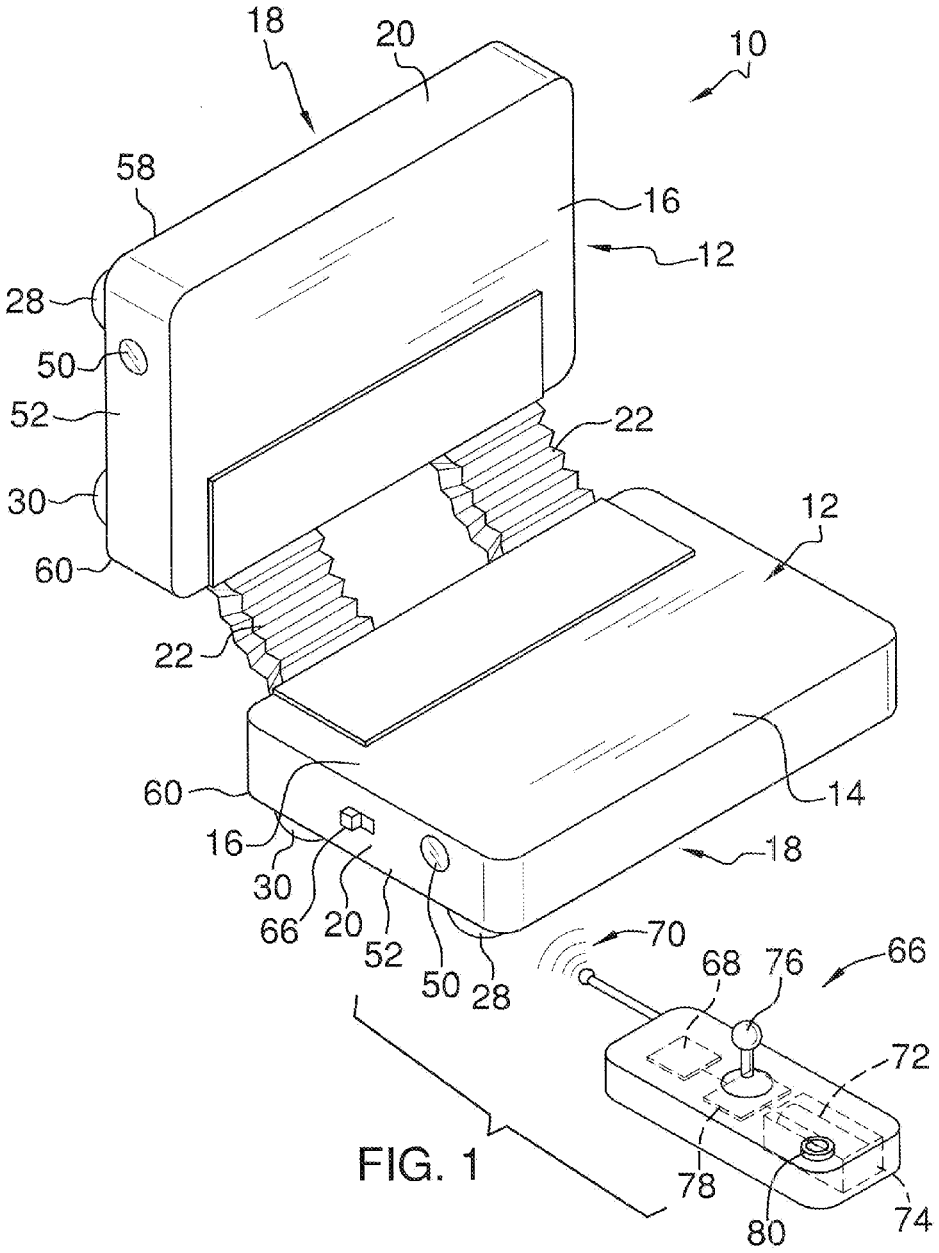
FIG. 1 is a top front side perspective view of a stair vacuum device according to an embodiment of the disclosure.
Figure 2:
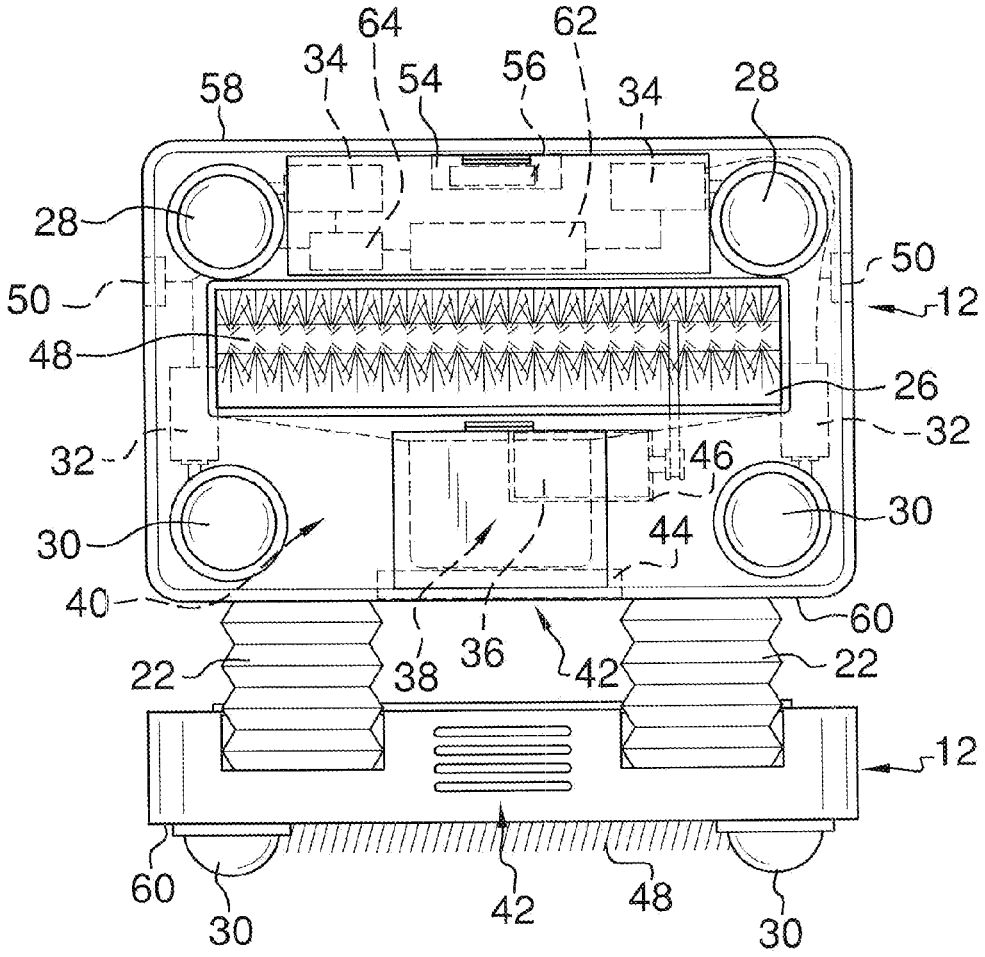
FIG. 2 is a bottom view of an embodiment of the disclosure.
Figure 3:
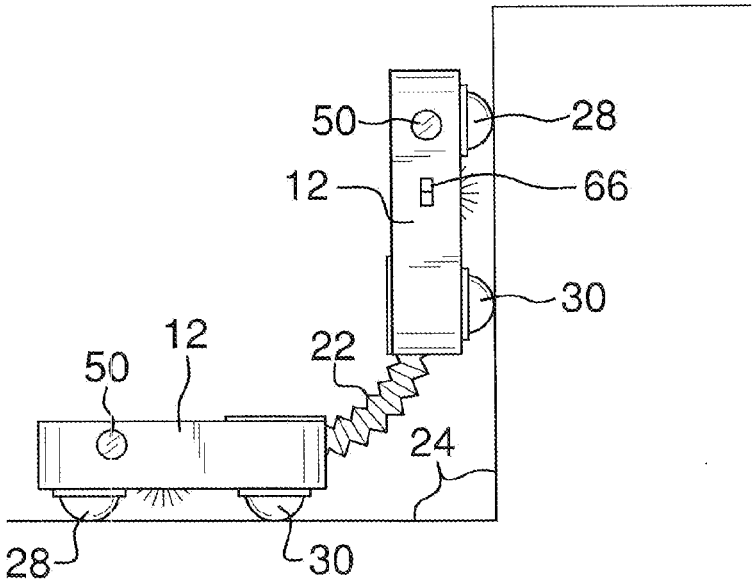
FIG. 3 is a side view of an embodiment of the disclosure.
Figure 4:
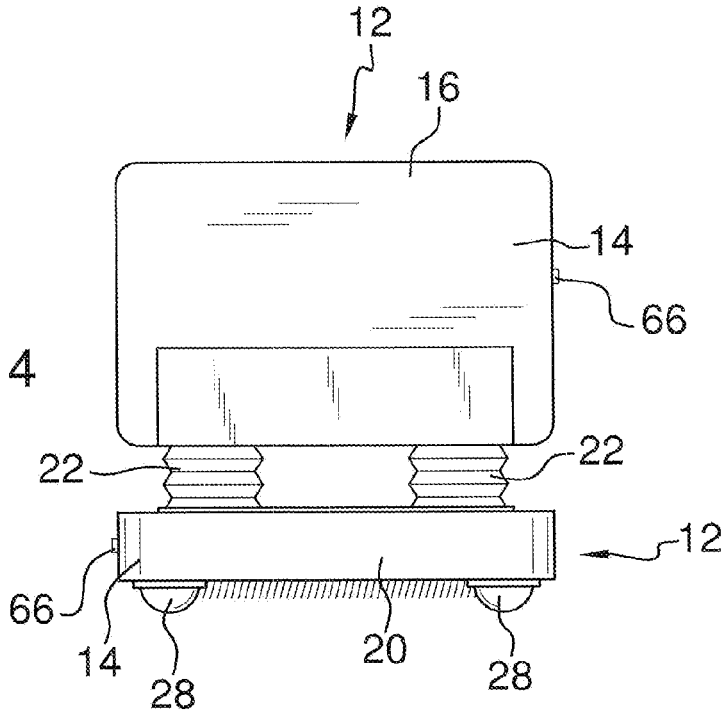
FIG. 4 is a front view of an embodiment of the disclosure.
Figure 5:
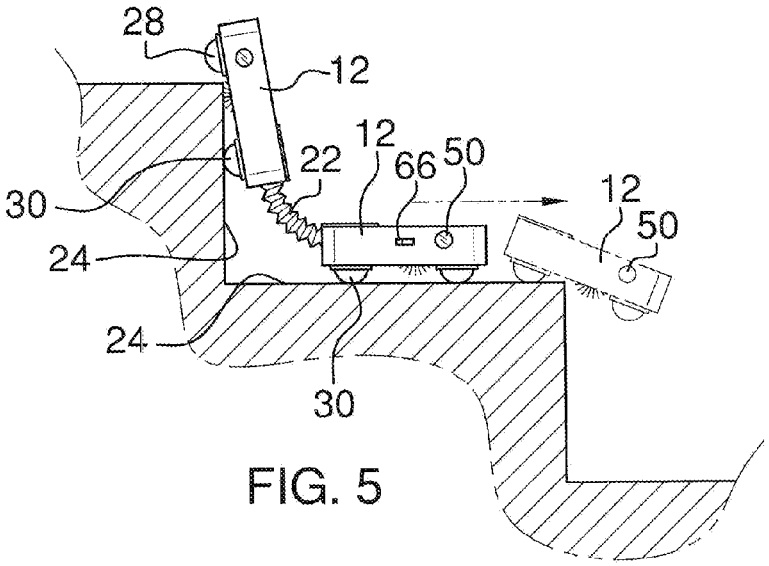
FIG. 5 is a side view of an embodiment of the disclosure in use.
Figure 6:
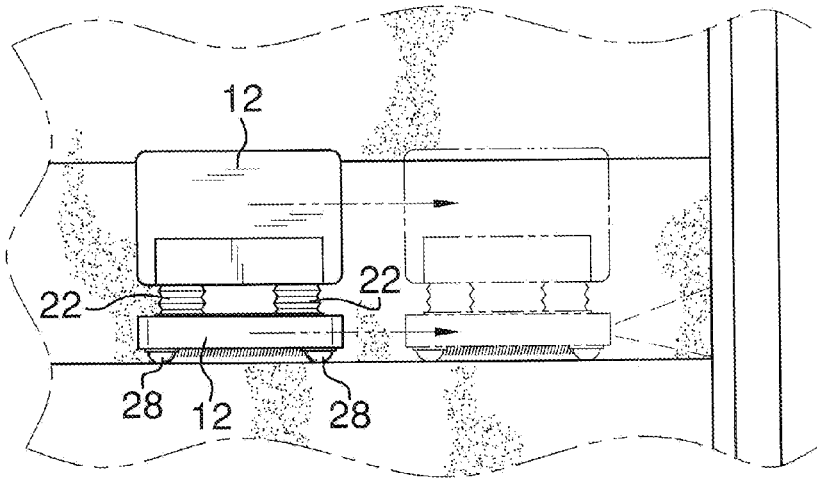
FIG. 6 is a front view of an embodiment of the disclosure in use.

With reference now to the drawings, and in particular to FIGS. 1 through 6 thereof, a new vacuum device embodying the principles and concepts of an embodiment of the disclosure and generally designated by the reference numeral 10 will be described.

As best illustrated in FIGS. 1 through 6, the stair vacuum device 10 generally comprises a pair of vacuum units 12.

Each vacuum unit 12 comprises a vacuum housing 14 having a top surface 16, a bottom surface 18, and a perimeter wall 20 extending between the top surface 16 and the bottom surface 18. A pair of connectors 22 couple the vacuum units 12 together such that the vacuum units 12 are positioned in spaced relationship. The vacuum units 12 move in tandem to vacuum adjacent stair surfaces 24 simultaneously. Each connector 22 may be flexible and mechanically controlled by a mechanism in conventional fashion to control pivoting of the vacuum units 12 as the vacuum units 12 move from stair to stair as described more fully below. A single connector 22 may be provided or the pair of connectors 22 may be positioned in spaced relationship to each other extending between the vacuum units 12.

Each vacuum unit 12 has a slot 26 extending through the bottom surface 18 of the vacuum housing 14. A plurality of side rollers 28 is coupled to the vacuum housing 14 on the bottom surface 18. The side rollers 28 are configured for moving the vacuum housing 14 in a first direction which is transverse relative to the connectors 22 extending between the vacuum housings 14. A plurality of side motors 34 may be provided for each vacuum unit 12. Each side motor 34 is operationally coupled to an associated one of the side rollers 28 and may be reversible to provide lateral movement of the device 10 in opposite directions. A plurality of forward rollers 30 is also coupled to the vacuum housing 14 on the bottom surface 18. The forward rollers 30 are configured for moving the vacuum housing 14 in a second direction transverse to the first direction. A plurality of forward motors 32 is provided with each forward motor 32 being operationally coupled to an associated one of the forward rollers 30. The side rollers 28 may be positioned adjacent to a distal edge 58 of the vacuum housing 14 relative to the connectors 22. Each of the forward rollers 30 may be positioned adjacent to a proximal edge 60 of the vacuum housing 14 relative to the connector 22.

In each vacuum unit 12, a suction device 36 is coupled to and positioned in the vacuum housing 14 such that the suction device 36 provides suction through the slot 26 in the vacuum housing 14. A bag compartment 38 is positioned in an interior space 40 of the vacuum housing 14. A vent aperture 42 may extend through the vacuum housing 14 adjacent to the bag compartment 38. A vent filter 44 may be positioned adjacent to and covering the vent aperture 42 if desired. A suction filter 46 may also be coupled to the suction device 36. A beater bar 48 may be coupled to the vacuum housing 14 in a conventional manner such that the beater bar 48 is positioned in and extends along the slot 26. Each of a pair of side sensors 50 is coupled to an associated side section 52 of the perimeter wall 20 of the vacuum housing 14 of each vacuum unit 12. The side sensors 50 are operationally coupled to the side motors 34 to selectively reverse direction of the side motors 34 or stop engagement of the side motors 34 and initiate engagement of the forward motors 32 according to a pre-programmed pattern to promote movement of the device 10 down a stairway.

Each vacuum unit 12 has a battery compartment 54 and a battery 56. The battery 56 is electrically coupled to each side motor 34, each forward motor 32, and the suction device 36 of the vacuum unit 12. Each vacuum unit 12 may also have a switch 66 electrically coupled to the side motors 34, forward motors 32, suction device 46, sensor 50, and battery 56. The switch 66 is positioned on the perimeter wall 20 of the vacuum unit 12. The vacuum units 12 may be constructed to be structural equivalents to reduce production costs.

Each vacuum unit 12 may further include a processor 62 coupled to and positioned in the vacuum housing 14. The processor 62 is operationally coupled to the forward motors 32 and the side motors 34. A receiver 64 is coupled to and positioned in the vacuum housing 14. The receiver 64 is communicatively coupled to the processor 62. A remote control unit 66 may be provided having a transmitter 68. The transmitter 68 selectively transmits control signals 70 to the receiver 64 of each vacuum unit 12. A remote battery 72 may be coupled to and positioned in the remote control unit 66 in a battery compartment 74. The remote battery 72 is electrically coupled to the transmitter 68. A directional control 76 such as a joystick or the like is coupled to the remote control unit 66. The directional control 76 is communicatively coupled to the transmitter 68 wherein the transmitter 68 transmits the control signals 70 to the receiver 66 of each vacuum unit 12. Thus, the vacuum units 12 may be moved by manipulation of the directional control 76. Additional operations of the vacuum units 12 may be programmed into the remote control unit 66 using a remote processor 78 communicatively coupled to the transmitter 68. A power switch 80 may also be provided on the remote control unit 66 and operationally coupled to the remote processor 78. The power switch 80 may control both the remote control unit 66 and each vacuum unit 12.

In use, the device 10 is positioned at the top of a stairway. The device 10 moves laterally at least once across the uppermost stair driven by the side motors 34 actuating the side rollers 38. The forward rollers 30 are engaged by the forward motors 32 moving the device 10 to the next step on the stairway. The process continues automatically until the device 10 reaches the bottom step of the stairway.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A stair vacuum device comprising:

a pair of vacuum units, each vacuum unit comprising a vacuum housing, said vacuum housing having a top surface, a bottom surface, and a perimeter wall extending between said top surface and said bottom surface, a slot extending through said bottom surface of said vacuum housing, a plurality of side rollers coupled to said vacuum housing, said side rollers being configured for moving said vacuum housing in a first direction, a plurality of forward rollers coupled to said vacuum housing, said forward rollers being configured for moving said vacuum housing in a second direction transverse to said first direction, and a suction device being coupled to and positioned in said vacuum housing such that said suction device provides suction through said slot in said vacuum housing;

a connector coupling said vacuum units together in spaced relationship wherein said vacuum units move in tandem to vacuum the adjacent stair surfaces simultaneously.

2. The device of claim 1, further comprising each vacuum unit comprising a plurality of forward motors, each said forward motor being operationally coupled to an associated one of said forward rollers.

3. The device of claim 1, further comprising each vacuum unit comprising a plurality of side motors, each said side motor being operationally coupled to an associated one of said side rollers.

4. The device of claim 1, further comprising each vacuum unit comprising a bag compartment positioned in an interior space of said vacuum housing.

5. The device of claim 4, further comprising each vacuum unit comprising a vent aperture extending through said vacuum housing, said vent aperture being adjacent to said bag compartment.

6. The device of claim 5, further comprising each vacuum unit comprising a vent filter positioned adjacent to and covering said vent aperture.

7. The device of claim 1, further comprising each vacuum unit comprising a suction filter coupled to said suction device.

8. The device of claim 1, further comprising each vacuum unit comprising a beater bar coupled to said vacuum housing said beater bar being positioned in and extending along said slot.

9. The device of claim 1, further comprising each vacuum unit comprising a pair of side sensors, each side sensor being coupled to an associated side section of said perimeter wall of said vacuum housing, said side sensors being operationally coupled to said side motors.

10. The device of claim 1, further comprising each of said side rollers of each vacuum unit being positioned adjacent to a distal edge of said vacuum housing relative to said connector.

11. The device of claim 1, further comprising each of said forward rollers or each vacuum unit being positioned adjacent to a proximal edge of said vacuum housing relative to said connector.

12. The device of claim 1, each vacuum unit further comprising:

a plurality of forward motors, each said forward motor being operationally coupled to an associated one of said forward rollers;

a plurality of side motors, each said side motor being operationally coupled to an associated one of said side rollers;

a battery compartment; and a battery, said battery being electrically coupled to each said side motor, each said forward motor, and said suction device of said vacuum unit.

13. The device of claim 1, further comprising a pair of said connectors, each said connector being flexible, said connectors being positioned in spaced relationship to each other, said connectors extending between said vacuum housings in spaced relationship to each other.

14. A stair vacuum device comprising:

a pair of vacuum units, each vacuum unit comprising a vacuum housing, said vacuum housing having a top surface, a bottom surface, and a perimeter wall extending between said top surface and said bottom surface, a slot extending through said bottom surface of said vacuum housing, a plurality of side rollers coupled to said vacuum housing, said side rollers being configured for moving said vacuum housing in a first direction, a plurality of forward rollers coupled to said vacuum housing, said forward rollers being configured for moving said vacuum housing in a second direction transverse to said first direction, and a suction device being coupled to and positioned in said vacuum housing such that said suction device provides suction through said slot in said vacuum housing, a plurality of forward motors, each said forward motor being operationally coupled to an associated one of said forward rollers, a plurality of side motors, each said side motor being operationally coupled to an associated one of said side rollers, a bag compartment positioned in an interior space of said vacuum housing, a vent aperture extending through said vacuum housing, said vent aperture being adjacent to said bag compartment, a vent filter positioned adjacent to and covering said vent aperture, a suction filter coupled to said suction device, a beater bar coupled to said vacuum housing said beater bar being positioned in and extending along said slot, a pair of side sensors, each side sensor being coupled to an associated side section of said perimeter wall of said vacuum housing, said side sensors being operationally coupled to said side motors, a battery compartment, a battery, said battery being electrically coupled to each said side motor, each said forward motor, and said suction device of said vacuum unit, a processor coupled to and positioned in said vacuum housing, said processor being operationally coupled to said forward motors and said side motors, and a receiver coupled to and positioned in said vacuum housing, said receiver being communicatively coupled to said processor;

a pair of connectors coupling said vacuum units together such that said vacuum units are positioned in spaced relationship and said vacuum units move in tandem to vacuum the adjacent stair surfaces simultaneously, each said connector being flexible, said connectors being positioned in spaced relationship to each other, said connectors extending between said vacuum housings in spaced relationship to each other, each of said side rollers of each vacuum unit being positioned adjacent to a distal edge of said vacuum housing relative to said connector, each of said forward rollers or each vacuum unit being positioned adjacent to a proximal edge of said vacuum housing relative to said connector;

a remote control unit having a transmitter, said transmitter selectively transmitting control signals to each said receiver;

a remote battery coupled to and positioned in said remote control unit, said battery being electrically coupled to said transmitter; and a directional control coupled to said remote control unit, said direction control being communicatively coupled to said transmitter wherein said transmitter transmits said control signals to said receivers wherein said vacuum units are moved by manipulation of said directional control.

* * * * *